United States Patent [19]

Sumida

[11] Patent Number: 5,049,932

[45] Date of Patent: Sep. 17, 1991

[54] COPIER HAVING AN EDITING FUNCTION

[75] Inventor: Hiroyasu Sumida, Ichikawa, Japan

[73] Assignee: Ricoh Company, Ltd., Japan

[21] Appl. No.: 475,888

[22] Filed: Feb. 6, 1990

[30] Foreign Application Priority Data

Feb. 10, 1989 [JP] Japan ..... 1-32317

[51] Int. Cl.[5] ..... G03G 21/00

[52] U.S. Cl. ..... 355/218; 355/40; 355/55; 355/243

[58] Field of Search ..... 355/218, 243, 40, 55, 355/266, 210

[56] References Cited

U.S. PATENT DOCUMENTS 4,796,052 1/1989 Mizutani et al. ..... 355/218
4,816,867 3/1989 Ito ..... 355/218
4,819,029 4/1989 Ito ..... 355/218

*Primary Examiner*—A. T. Grimley
*Assistant Examiner*—Sandra L. Hoffman
*Attorney, Agent, or Firm*—Mason, Fenwick & Lawrence

[57] ABSTRACT

A copier with an editing function and operable in operable in a trimming mode for extracting part of an image printed on a document as a trimmed image and transferring it to a paper sheet, a masking mode for omitting part of the image as a masked image and transferring a non-masked image surrounding the masked image to the paper sheet, and a centering mode combinable with either one of the trimming mode and masking mode for shifting the center of the image on the document into register with the center of the paper sheet and transferring it to the paper sheet. Centering in the trimming mode transfers the trimmed image to the center of a paper sheet by using the trimmed image itself as a reference. Centering in the masking mode transfers the image on the document to the center of a paper sheet in the same manner as ordinary centering without taking account of the dimensions of the masked image, i.e., by shifting the document image by an amount matching the size of the paper sheet and the size of the document.

5 Claims, 12 Drawing Sheets

COPIER HAVING AN EDITING FUNCTION

BACKGROUND OF THE INVENTION

The present invention relates to a copier having an editing function and operable in a trimming mode for extracting part of an image printed on a document as a trimmed image and transferring it to a paper sheet, a masking mode for omitting part of the image as a masked image and transferring a non-masked image surrounding the masked image to the paper sheet, and a centering mode combinable with either one of the trimming mode and masking mode for shifting the center of the image on the document into register with the center of the paper sheet and transferring it to the paper sheet.

Most of copiers with an editing function do not allow one to select a centering mode in combination with either one of the trimming mode and masking mode, because the resulting combined mode would be complicated. Nevertheless, there has been proposed a copier with an editing function which is capable of meeting the user's need for the combined trimming mode or masking mode and centering mode. This type of copier is usually constructed such that when centering accompanies the trimming mode or the masking mode, marked part of a document image, i.e., a trimmed image or a masked image is located at the center of a paper sheet with the trimmed image or the masked image itself being used as a reference. More specifically, centering is executed such that the center of the trimmed image or that of the masked image itself coincides with the center of a paper sheet. Locating the center of the trimmed image at the center of a paper sheet does not matter at all because the trimmed image is the image to be transferred. Regarding the masked image, however, it is not the image to be transferred to a paper sheet, i.e., a non-masked image surrounding the masked image is the desired part of the document image. Furthermore, the masked image is not always located at the center of the non-masked image. For example, assume that the masked image is noticeably deviated from the center of the non-masked image, and that the non-masked image has a substantial size. Then, when the center of the masked image is brought into register with the center of a paper sheet, it is likely that the image to be transferred is partly located outside of the range of the paper sheet and thereby partly lost, depending on the size of the paper sheet.

SUMMARY OF THE INVENTION

It is therefore an object of the present invention to provide a copier with an editing function capable of transferring, in a centering mode combined with either one of a trimming mode and a masking mode, a trimmed image or a non-masked image while locating the center of such an image at the center of a paper sheet.

It is another object of the present invention to provide a generally improved copier having an editing function.

In a copier having an editing function and operable in a trimming mode for extracting part of an image printed on a document as a trimmed image and transferring the trimmed image to a paper sheet, a masking mode for omitting part of the image as a masked image and transferring a non-masked image surrounding the masked image to the paper sheet, and a centering mode combinable with either one of the trimming mode and masking mode for shifting the center of the image on the document into register with the center of the paper sheet and transferring the shifted image to the paper sheet, in accordance with the present invention, a first centering unit shifts the center of the image on the document by an amount which is calculated on the basis of a size of the document and a size of the paper sheet and transfers the shifted image to the center of the paper sheet. A second centering unit shifts the center of the trimmed image by an amount which is calculated on the basis of a size of the trimmed image and the size of the paper sheet and transfers the shifted trimmed image to the center of the paper sheet. The second centering unit is selected when the centering mode is combined with the trimming mode while the first centering unit is selected when the centering mode is combined with the masking mode.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a trimming mode, masking mode and centering mode available with a prior art copier having an editing function will be outlined first.

Figure 1:
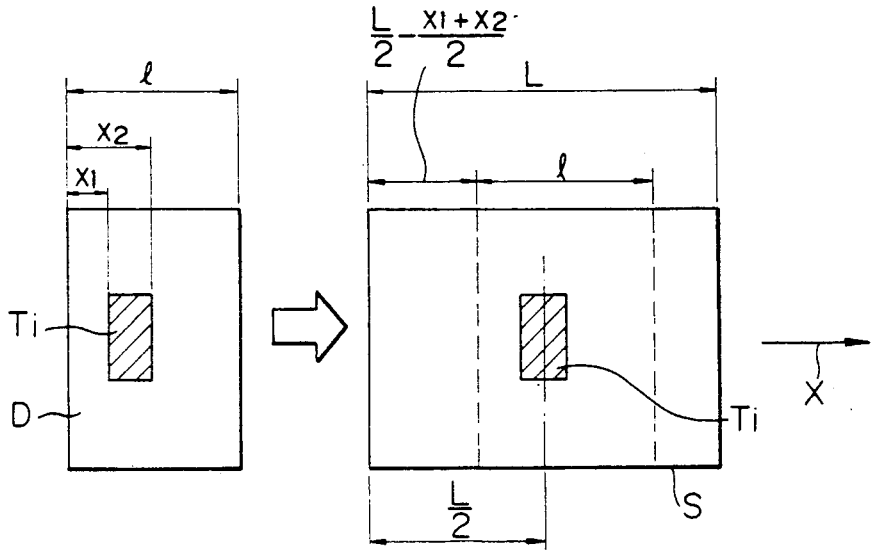
Fig.1 PRIOR ART
FIG. 1 is a schematic diagram demonstrating prior art centering which is effected in a trimming mode.

FIG. 1 indicates centering heretofore effected in the trimming mode. As shown, desired part of an image printed on a document D is marked and treated as a trimmed image Ti. The trimmed image Ti is transferred to a paper sheet S while being centered such that its center is located at the center of the paper sheet S. Assume that, with respect to an intended direction of paper transport (direction X), the document D has a length l, that the leading edge and the trailing edge of the trimmed image Ti are respectively located at coordinates $x_1$ and $x_2$, and that the paper sheet S has a length L. To center the trimmed image Ti as mentioned above, a register roller is so controlled as to delay the feed timing of the leading edge of the paper sheet S relative to that of the leading edge of the image on the document D such that the center of the trimmed image Ti coincides with the center of the paper sheet S, i.e. a position L/2 as measured from the leading edge of the sheet S. The resulting displacement of the image on the document D is expressed as:

$$\frac{L}{2} - x_1 - \frac{x_2 - x_1}{2} = \frac{L}{2} - \frac{x_1 + x_2}{2} \quad (1)$$

Figure 2:
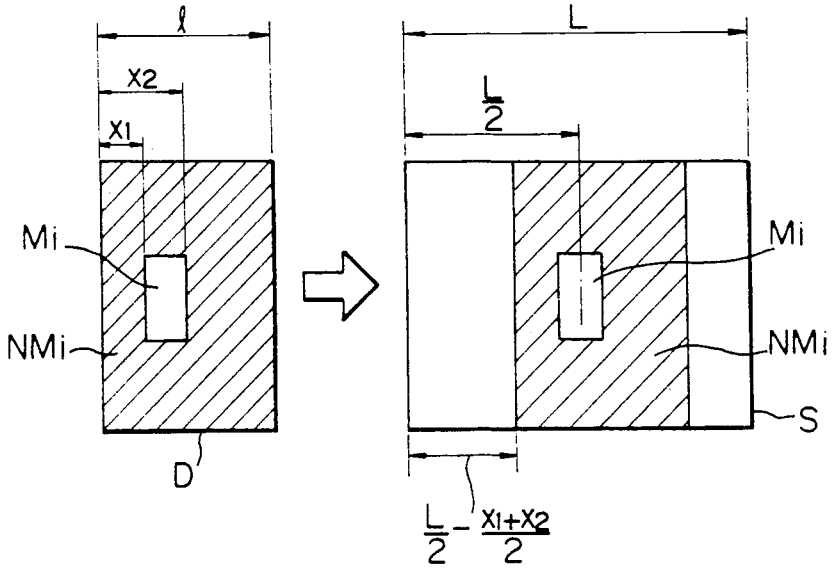
Fig.2 PRIOR ART
FIG. 2 is a schematic diagram demonstrating prior art centering which is effected in a masking mode.

FIG. 2 shows centering which may be effected in the masking mode by the prior art copier. In this mode, the image transfer timing is also controlled such that the center of a masked image Mi, i.e., part of the image on the document having been masked is brought into register with the center of the paper sheet S. In this case, it is the image left unmasked around the masked image Mi, or non-masked image NMi, that is transferred to the paper sheet S. Again, the displacement of the image on the document D is produced by the equation (1), as understood from FIG. 2.

As stated above, it has been customary to put the trimmed image Ti and the masked image Mi in the same category in the event of centering. Specifically, both of the images Ti and Mi are centered on the paper sheet S while being used as a reference themselves.

Figure 3:
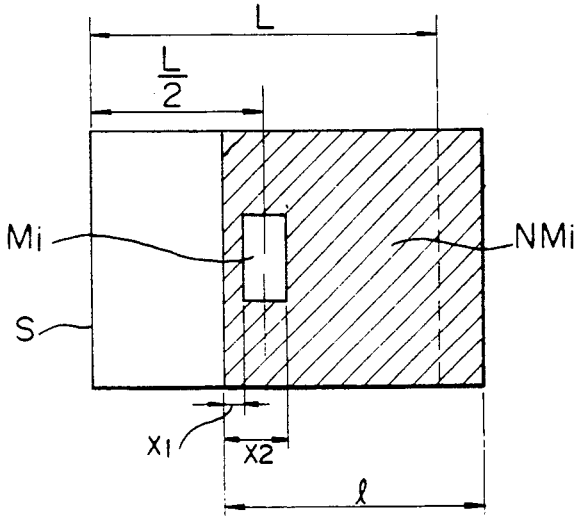
Fig.3 PRIOR ART
FIG. 3 is a schematic diagram illustrating a problem particular to the centering procedure shown in FIG. 2.

As shown in FIG. 3, assume that the size (length) l of the document D is smaller than the size (length) L of the paper sheet S, and that a relation $l-\{(x_2-x_1)/2\}$ holds by way of example. Then, the prior art centering procedure described above has a problem that in the masking mode, for example, the image on the document D is partly lost when reproduced on the paper sheet S. Specifically, since copying an image in the masking mode means transferring only the non-masked image NMi surrounding the masked image Mi to the paper sheet S, an image partly lost as mentioned above or, if not lost, deviated with respect to the center of the paper sheet S as shown in FIG. 2 appears odd and, therefore, should be eliminated.

Figure 4:
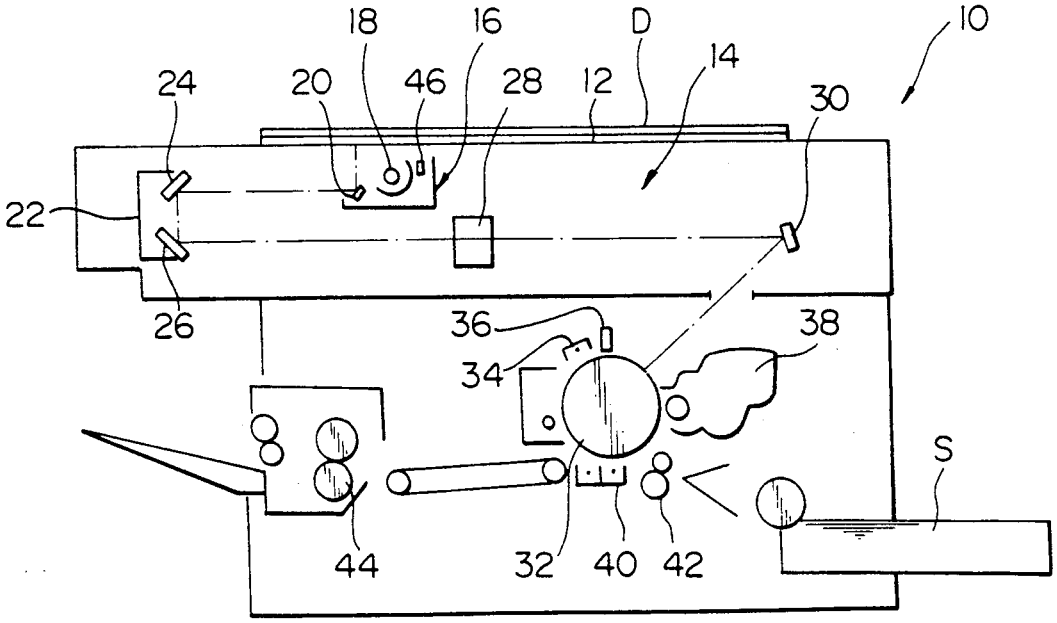
FIG. 4 is vertical section schematically showing a copier embodying the present invention.

Referring to FIG. 4, a copier with an editing function embodying the present invention is shown which is free from the problem particular to the prior art as discussed above. The copier, generally 10, has a glass platen 12 and optics 14 for scanning a document D which is laid on the glass platen 12. The optics 14 is made up of a first scanner 16 having a light source 18 and a first mirror 20, a second scanner 28 having a second and a third mirror 24 and 26, respectively, and movable at a speed which is one half of the speed of the first scanner 16, a lens 28 movable along its optical axis in matching relation to magnification, and a fourth mirror 30. A photoconductive element in the form of a drum 32 is disposed in the copier 10. The optics 14 electrostatically forms a latent image on the drum 32. Arranged around the drum 32 are a main charger 34, an eraser 36, a developing unit 38, a transfer and separation charger 40, and so on which are positioned to implement a predetermined electrophotographic procedure. There are also shown in the figure a register roller 42 for feeding a paper sheet S at a predetermining timing toward an image transfer position, a fixing unit 44 for fixing an image having been transferred to the paper sheet S, and a document size sensor 46 mounted on the first scanner 16 for sensing the size of a document D during prescanning which occurs before an actual copying operation.

Figure 5:
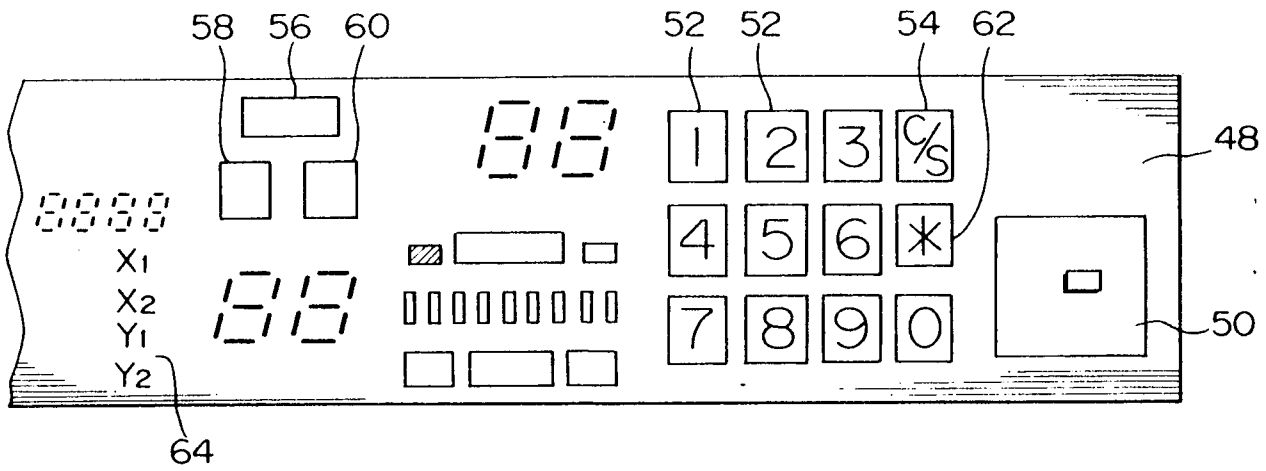
FIG. 5 is a schematic plan view of an operation board mounted on the copier of FIG. 4.

As shown in FIG. 5, the copier 10 has an operation board 48 which is loaded with various kinds of keys. Specifically, the keys include a copy start key 50, numeral keys 52, a clear/stop key 54, a center key 56, a trim key 58, and a mask key 60. The keys further include an enter key 62 accessible for entering the dimensions of a marked area which have been selected on the numeral keys 52 in a trimming mode or a masking mode. Also provided on the operation board 48 is a display 64 for guiding the operator as to the kind of a dimension to be entered (directions x and y).

Basically, in the centering mode, while a displacement is calculated on the basis of a document size l sensed by the document size sensor 46 and a paper size L, the register roller 42 drives a paper sheet at a timing which is controlled commensurately with the displacement. This allows a document image to be centered on a paper sheet. In a trimming mode or a masking mode, the eraser 36 is driven at a predetermined timing and over a predetermined width to erase part of a document image lying outside of or inside of a marked area.

In the illustrative embodiment, the trimming mode and the masking mode are each combined with the centering mode in a different way. This will be described with reference to FIGS. 6 and 7.

Figure 6:
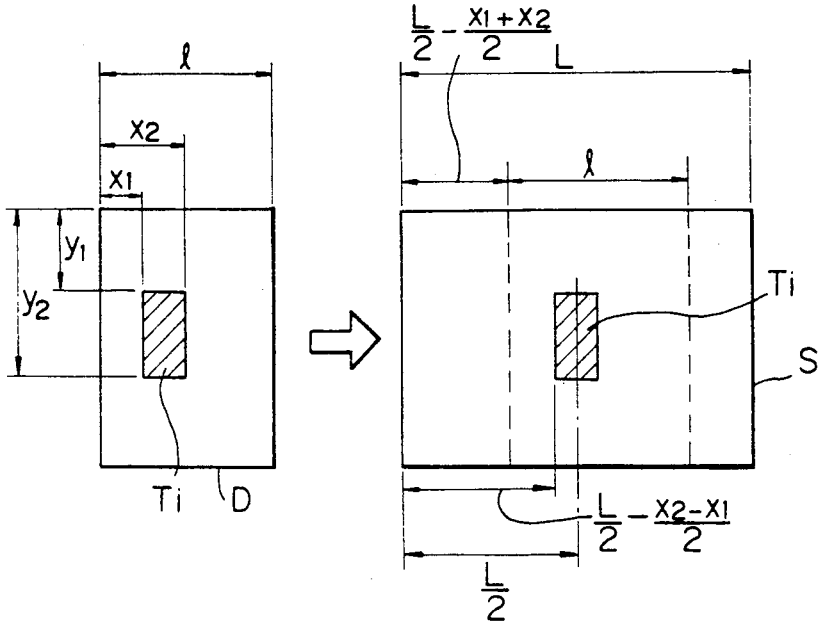
FIG. 6 is a schematic diagram representative of centering which is effected in a trimming mode in the illustrative embodiment.

FIG. 6 shows a centering procedure which is effected in the trimming mode. As shown, desired part a document D having a length l as measured in the direction for feeding a paper sheet S is marked by coordinates ($x_1$, $y_1$), ($x_2$, $y_2$), ($x_1$, $y_2$) and ($x_2$, $y_1$). The marked part, i.e., a trimmed image Ti is transferred to the paper sheet S having a length L while being centered thereon. Specifically, the trimmed image Ti is centered on the paper sheet S by shifting the document image, i.e., controllably driving the register roller 42 to change the feed timing of the paper sheet S relative to the image formed on the drum 32. In this respect, this centering procedure is identical with the procedure previously described with reference to FIG. 1. The leading edge of the trimmed image Ti undergone the centering operation is located at a particular position as measured from the leading edge of the paper sheet S, as follows:

$$\frac{L}{2} - \frac{x_2 - x_1}{2} \quad (2)$$

It will be seen that the deviation of the leading edge of the paper sheet S from the leading edge of the image on the document D (amount of shift of the document image) is the same as the deviation represented by the equation (1), i.e., the paper sheet S goes ahead of the document D by the amount represented by the equation (1).

Figure 7:
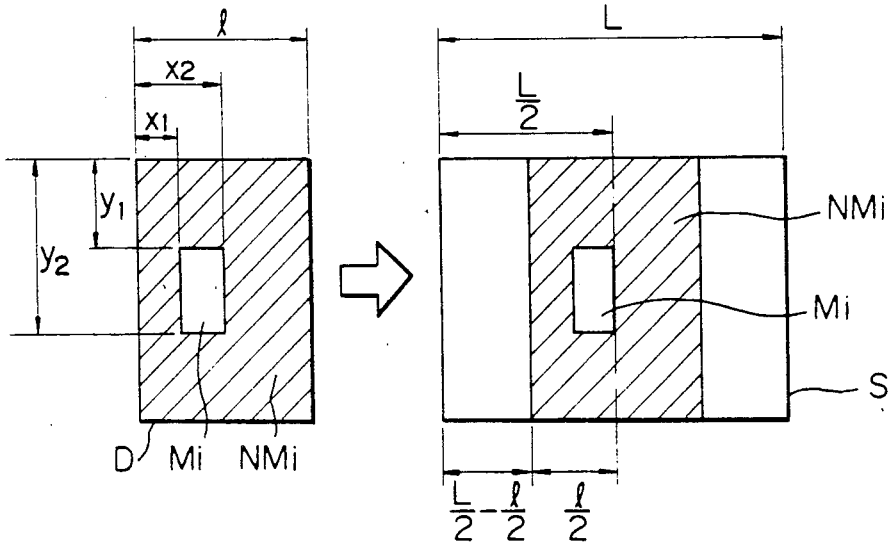
FIG. 7 is a schematic diagram representative of centering which is effected in a masking mode in the illustrative embodiment.

On the other hand, centering in the masking mode is executed in the same manner as ordinary centering. Specifically, FIG. 7 shows a case wherein a desired area of the document D having a length l is masked by being marked by coordinates ($x_1$, $y_1$), ($x_2$, $y_1$), ($x_1$, $y_2$) and ($x_2$, $y_2$), and only the non-masked image NMi is transferred to the paper sheet S having a length L while being centered thereon. Here, it is noteworthy that the centering is based on the dimensions of the entire document D and not on the dimensions of the masked image Mi, i.e., only the size or length l of the document D and the size or length L of the paper sheet S are taken into account in determining the amount of shift of the image necessary for centering, as usual. Hence, the leading edge of the centered image of the document D is transferred to a position which is represented by L/2−l/2 as measured from the leading edge of the paper sheet S. More specifically, by the centering effected in the masking mode, there is set up a particular positional relationship (amount of shift of the document image) between the leading edge of the document D and that of the paper sheet S which is such that the leading edge of the paper sheet S goes ahead of that of the document D by an amount:

$$\frac{L}{2} - \frac{l}{2} \tag{3}$$

Figure 8:
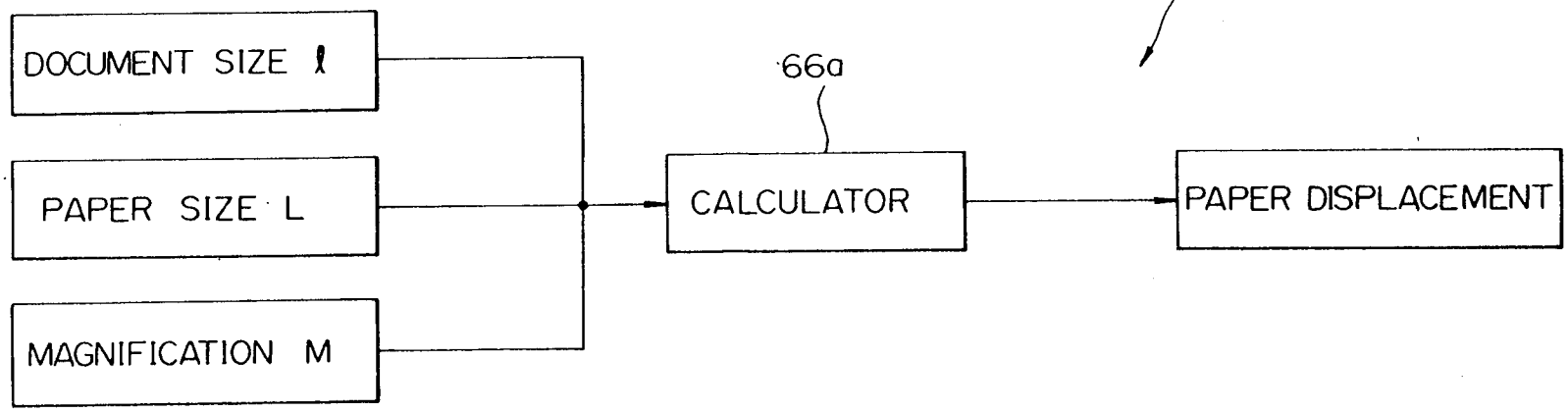
FIGS. 8 and 9 are block diagrams showing essential part of the illustrative embodiment.
Figure 9:
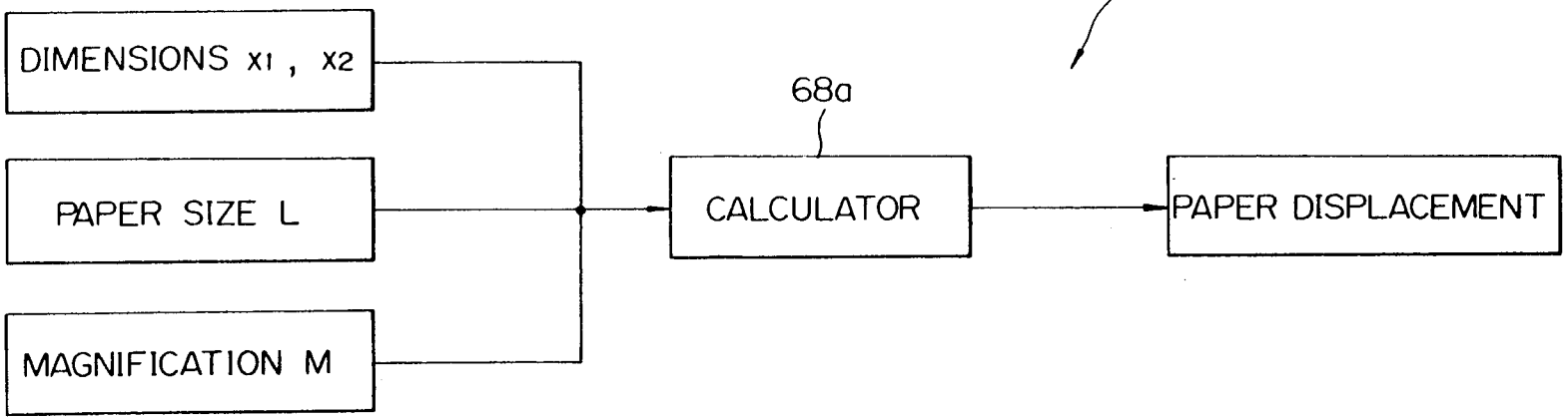

In the illustrative embodiment, the principle described above is implemented by an ordinary centering unit 66 shown in FIG. 8 and an exclusive centering unit 68 for trimming shown in FIG. 9. The ordinary centering unit 66 has a calculator 66*a* for determining an amount of displacement of the paper sheet S (corresponding to an amount of shift of the document D) on the basis of the size l of the document D and the size L of the paper sheet S and, in the event of magnification change, the magnification M. The exclusive centering unit 68 for trimming has a calculator 68*a* for determining an amount of displacement of the paper sheet (corresponding to an amount of shift of the trimmed image Ti) on the basis of the data $x_1$ and $x_2$ representative of the size of the trimmed image Ti and the size L of the paper sheet S and, in the event of magnification change, the magnification M. The exclusive centering unit 68 controls centering when the centering mode in the trimming mode is selected, while the ordinary centering unit 66 controls centering when the centering mode in the masking mode is selected. A switching device, not shown, is provided for selecting either one of the centering units 66 and 68 which matches the desired mode.

Figure 10:
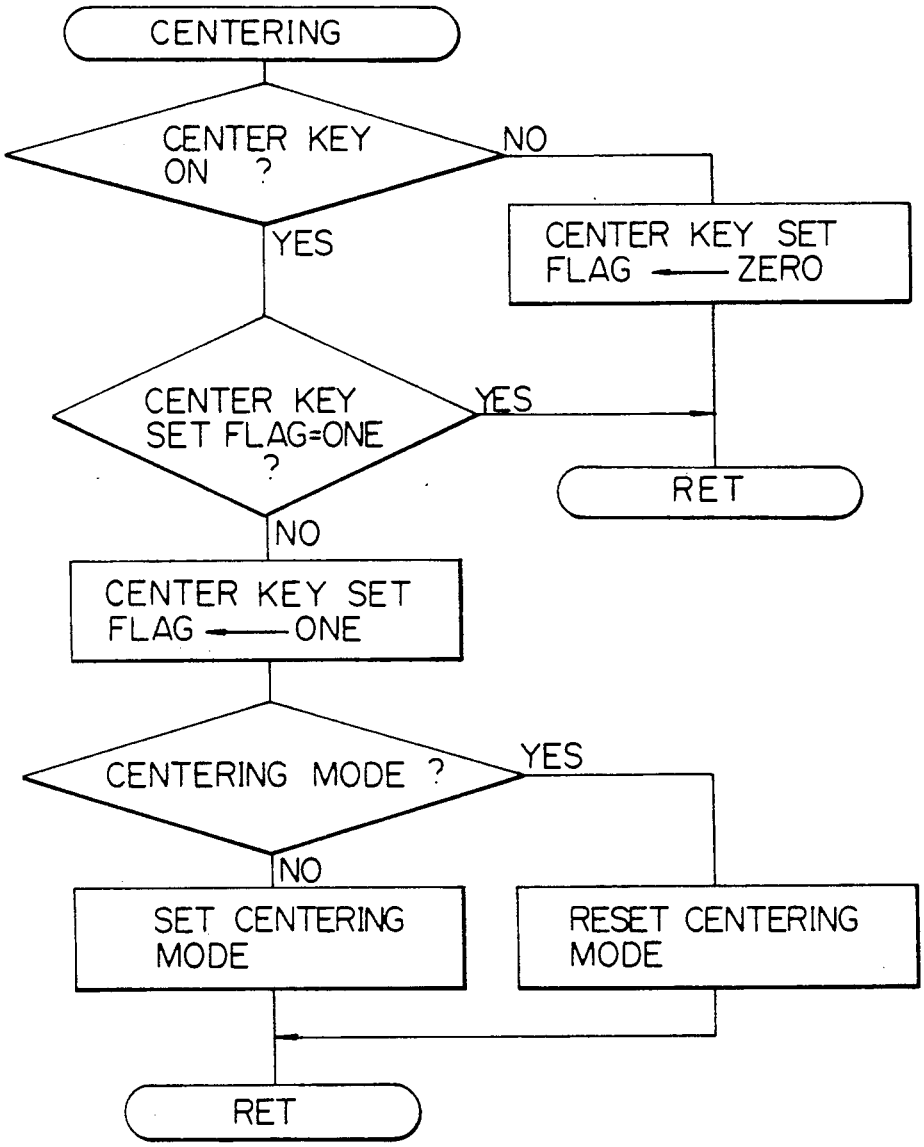
FIG. 10 is a flowchart showing a centering procedure.
Figure 11:
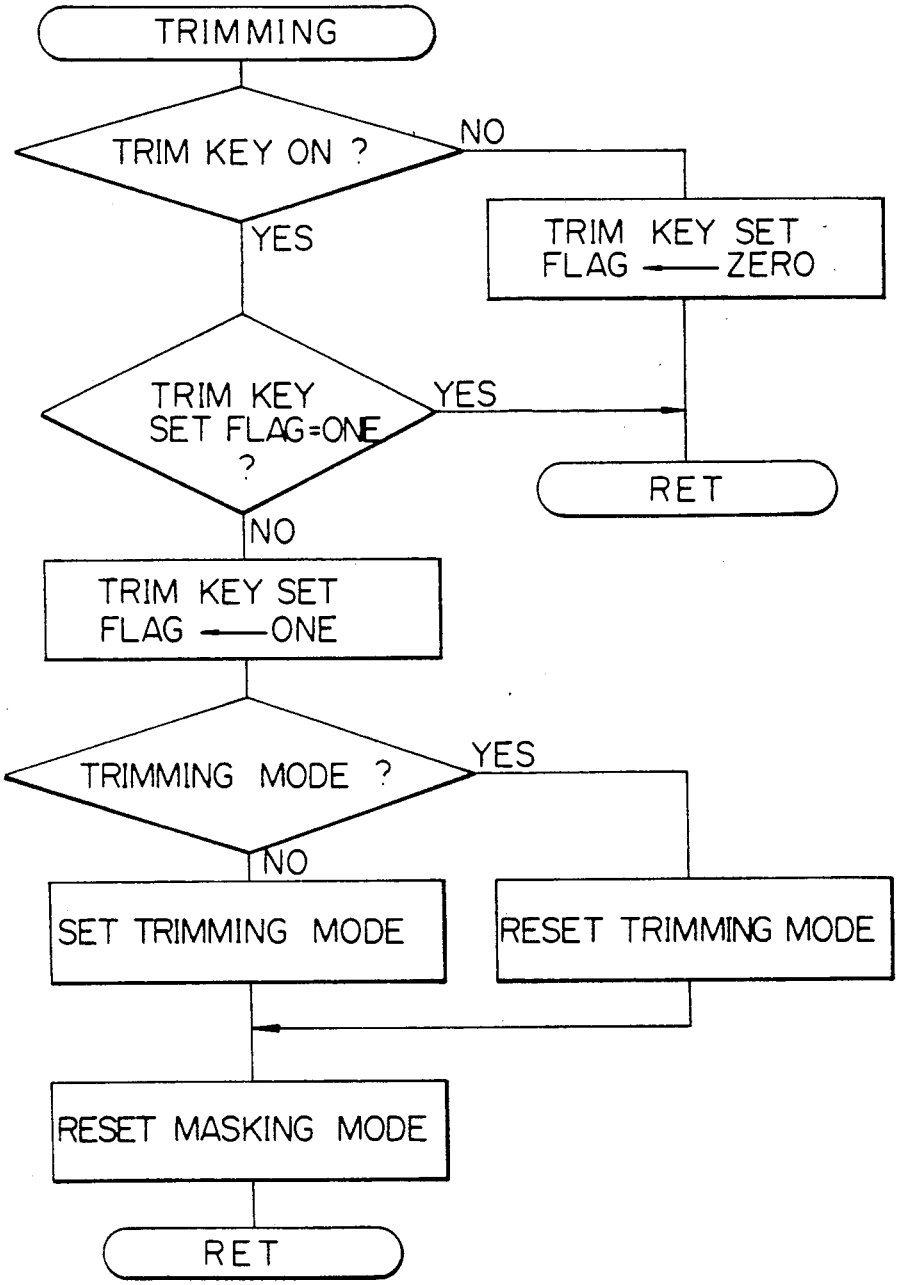
FIG. 11 is a flowchart showing a trimming procedure.
Figure 12:
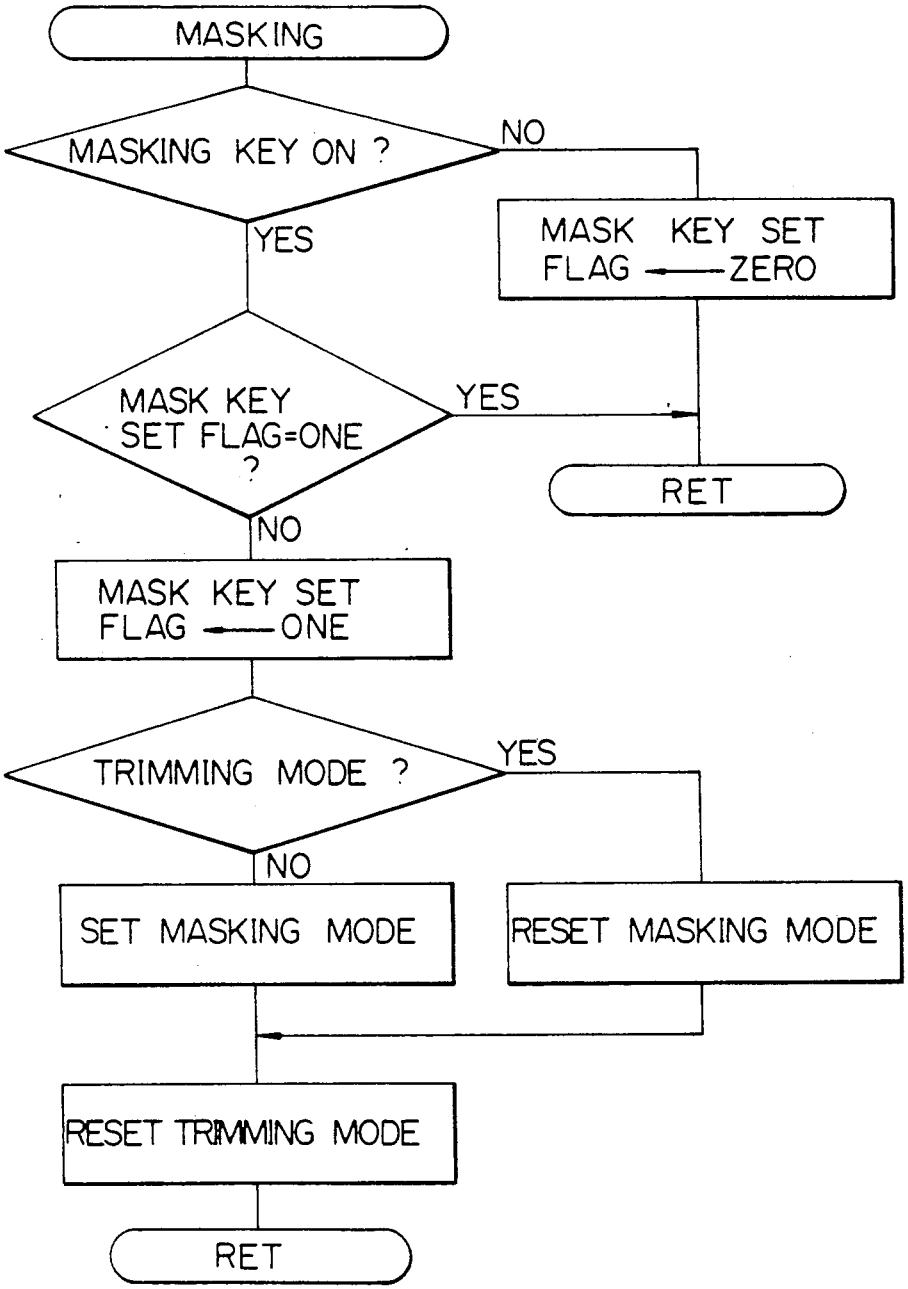
FIG. 12 is a flowchart showing a masking procedure.

Referring to FIGS. 10 to 13, a specific operation of the illustrative embodiment will be described. The copier 10 accepts inputs on any desired keys while it is in a stand-by state. Assume that the center key 56 is pressed by way of example. Then, as shown in FIG. 10, whether or not a center key set flag responsive to an ON edge associated with the key 56 is (logical) ONE is determined. If this flag is not ONE, it is turned to ONE. If the centering mode has already been set, the flag is cleared to become (logical) ZERO. If the centering mode has not been set, it is set. More specifically, the flag is set and reset alternately every time the center key 56 is pressed. When the trim key 58 is pressed, a sequence of steps shown in FIG. 11 are executed. As shown in FIG. 11, if the trimming mode has already been set, it is reset; if it has not been set, it is set. Since the trimming mode cannot be set up together with the masking mode, the masking mode is reset if it has been set before the operation of the trim key 58. FIG. 12 indicates a procedure for accepting an input on the mask key 60. The procedure shown in FIG. 12 is identical with the procedure of FIG. 11 except for the replacement of masking and trimming. In the selected mode, whether it be the trimming mode or the masking mode, a dimension input mode is set up to urge one to manipulate the numeral keys 52 for entering the dimensions $x_1$, $x_2$, $y_1$ and $y_2$ in this order and then the enter key 62. The dimensions $x_1$, $x_2$, $y_1$ and $y_2$ mark a particular area to be trimmed or masked.

Figure 13:
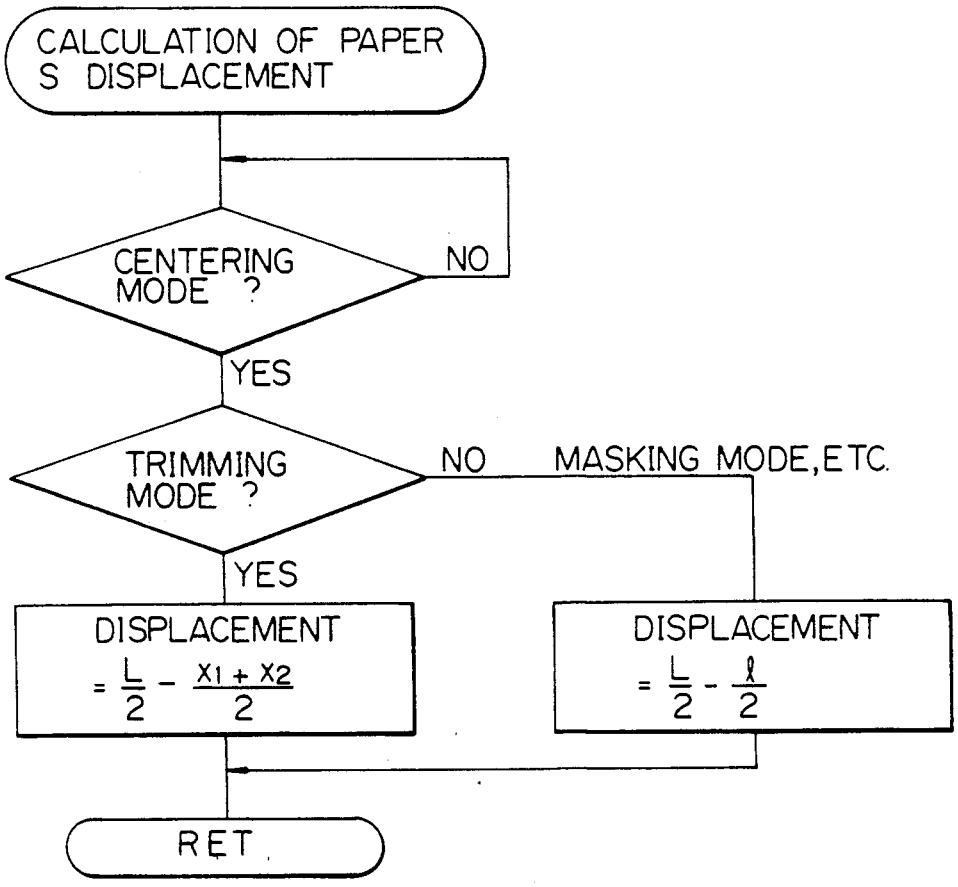
FIG. 13 is a flowchart showing a specific sequence for calculating an amount of displacement of a paper sheet.

After various kinds of modes have been set, a copying sequence will be started in response to the depression of the copy start key 50. Before the start of the copying sequence, the optics 14 prescans the document D to allow the document size sensor 46 to sense the document size l. Subsequently, an amount of displacement of the paper sheet S is calculated by selectively using the paper size L, document size l, dimensions $x_1$ and $x_2$ and so on in matching relation to the entered mode. Data representative of the so determined displacement is used to control the ON timing of the register roller 42, i.e., the feed timing of the paper sheet S. Specifically, as shown in FIG. 13, the displacement mentioned above is determined by using the equation (1) when centering in the trimming mode is selected, while it is determined by using the formula (3) when centering in the masking mode is selected. When centering in a mode other than the trimming mode is desired, the displacement is also determined on the basis of the formula (3). When the magnification is to be changed, it is also taken into account with no regard to the selected mode.

Figure 14:
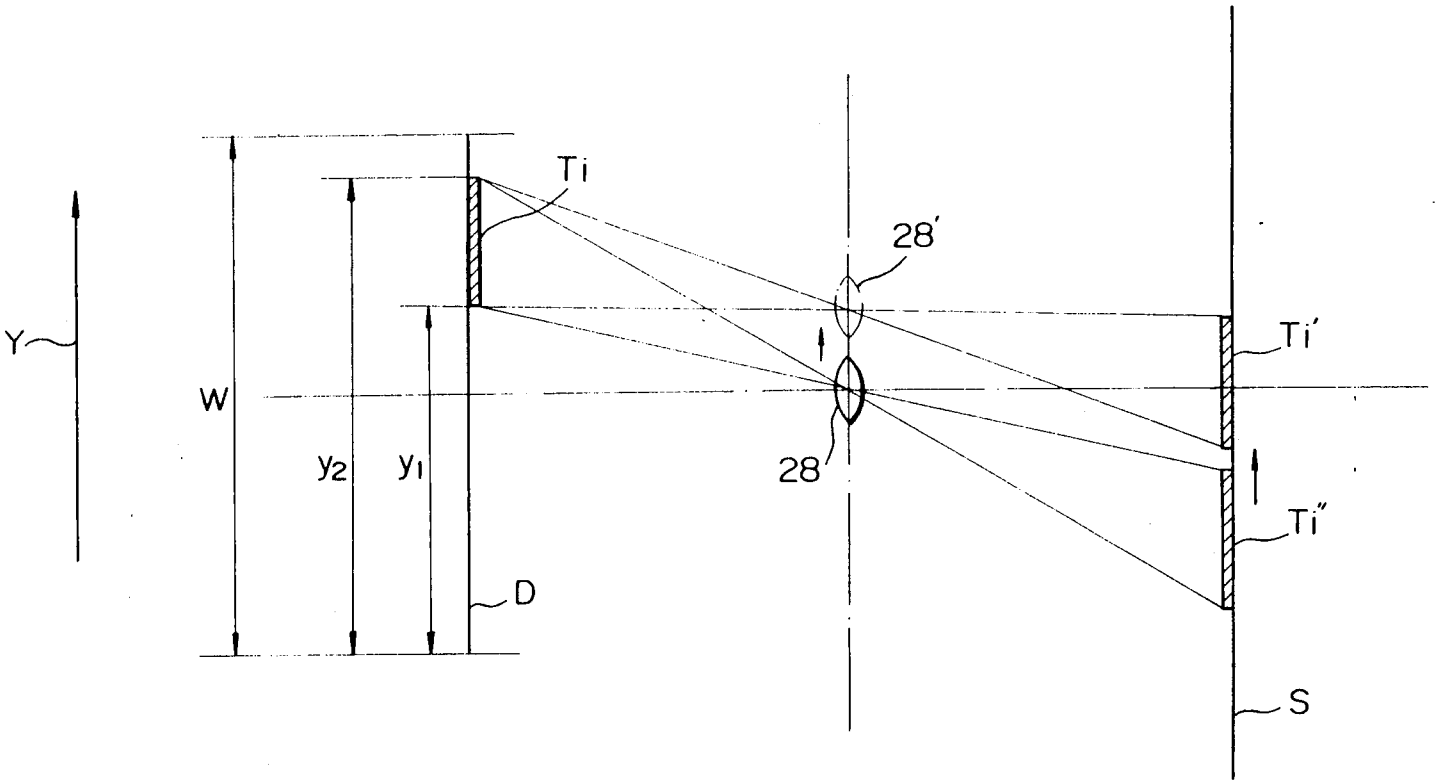
FIG. 14 is a schematic diagram demonstrating centering which is implemented with a lens.

The above description has concentrated on the centering operation effected in the direction X in which the paper sheet S is transported. With the illustrative embodiment, it is also possible to execute centering in a direction perpendicular to the direction X, i.e., a direction Y by moving the lens 28 in the direction Y. Specifically, as shown in FIG. 14, the amount of movement of the lens 28 is changed depending on the widthwise dimensions $y_1$ and $y_2$ of the trimmed image Ti (document D being assumed to have a widthwise dimension W). The distance which the lens 28 should be moved (corresponding to the shift of the document image) is determined by using the dimensions $y_1$ and $y_2$ of the trimmed image Ti and the document size W, as follows:

$$\frac{\frac{y_1 + y_2}{2} - \frac{W}{2}}{2} \tag{4}$$

Regarding the direction of movement, the lens 28 will be moved as indicated by an arrow in FIG. 14 (upward) if the formula (4) is positive and in the opposite direction if it is negative. When the lens 28 is displaced to a position 28' by a predetermined distance as determined by the formula (4), the trimmed image Ti will be transferred as a trimmed image Ti' to a position on the center line. Should the lens 28 be located on the center line, the trimmed image Ti would be transferred as a trimmed image Ti'' to a position deviated from the center line.

When the masking mode is selected, both the transport of the paper sheet S and the setting of the document D are performed by using the center line of the lens 28 as a reference. Centering in the masking mode, therefore, does not have to be effected in the direction Y in the illustrative embodiment. Specifically, while centering in the trimming mode requires the lens 28 to move a distance associated with the entered dimensions $y_1$ and $y_2$ in order to shift the image, centering in the masking mode does not involve the movement of the lens 28 in the direction Y with no regard to the entered dimensions.

Figure 15:
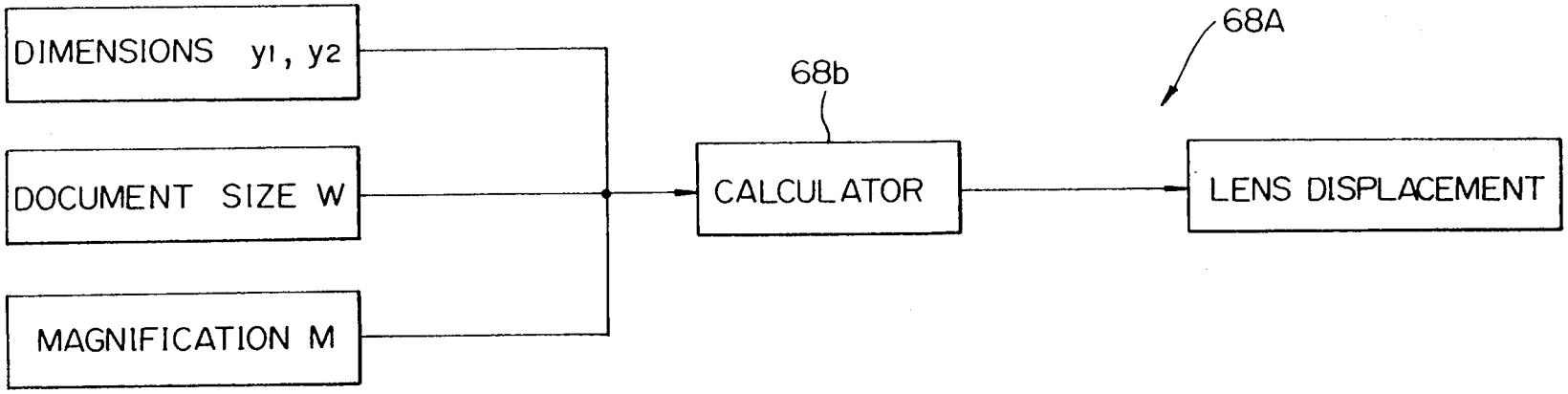
FIG. 15 is a block diagram showing another essential part of the illustrative embodiment in relation to FIG. 9.

To generalize the illustrative embodiment, ordinary centering occurs in the direction X only, as shown in FIG. 8. In contrast, centering in the trimming mode occurs not only in the direction X as shown in FIG. 9, but also in the direction Y. As shown in FIG. 15, centering in the direction Y is implemented with a calculator 68*b* which determines a displacement of the lens 28 on the basis of the dimensions $y_1$ and $y_2$ corresponding to the size of the trimmed image Ti and the size of the document D and, in the event of magnification change, the magnification M. Hence, when the centering mode in the trimming mode is selected, centering is executed by the exclusive centering unit 68 shown in FIG. 9 and a centering unit 68A shown in FIG. 15 while, when the centering mode in the masking mode is selected, only the ordinary centering unit 66 shown in FIG. 8 is used.

In summary, in accordance with the present invention, centering in a trimming mode is effected such that a marked or trimmed image to be reproduced is transferred to the center of a paper sheet with the trimmed image itself being used as a reference. On the other hand, centering in a masking mode is effected in the same manner as ordinary centering without taking account of the dimensions of a masked image, i.e., by shifting the entire document image in matching relation to the size of a document and that of a paper sheet such that the document image is transferred to the center of a paper sheet. Such centering in the masking mode is equivalent to centering a non-masked image which surrounds the masked image and should be actually reproduced, so that the resulting image on a paper sheet does not appear odd at all. Since centering is usually executed with a document which is smaller in size than a paper sheet, an image is substantially prevented from being partly lost by centering in the masking mode.

Various modifications will become possible for those skilled in the art after receiving the teachings of the present disclosure without departing from the scope thereof.

What is claimed is:

1. A copier having an editing function and operable in a trimming mode for extracting part of an image printed on a document as a trimmed image and transferring said trimmed image to a paper sheet, a masking mode for omitting part of said image as a masked image and transferring a non-masked image surrounding said masked image to said paper sheet, and a centering mode combinable with either one of said trimming mode and said masking mode for shifting the center of said image on said document into register with the center of said paper sheet and transferring said shifted image to said paper sheet, said copier comprising:

first centering means for shifting the center of the image on the document by an amount which is calculated on the basis of a size of said document and a size of the paper sheet and transferring said shifted image to the center of said paper sheet; and second centering means for shifting the center of the trimmed image by an amount which is calculated on the basis of a size of said trimmed image and the size of the paper sheet and transferring said shifted trimmed image to the center of the paper sheet;

said second centering means being selected when the centering mode is combined with the trimming mode while said first centering means being selected when said centering mode is combined with the masking mode.

2. A copier as claimed in claim 1, wherein said first centering means performs centering in an intended direction of transport of the paper sheet.

3. A copier as claimed in claim 1, wherein said second centering means performs centering in at least one of an intended direction of transport of the paper sheet and a direction perpendicular to said intended direction of transport.

4. A copier as claimed in claim 1, wherein in a magnification change mode said first centering means further takes account of a magnification change ratio in calculating the amount of shift of the center of the image on the document.

5. A copier as claimed in claim 1, wherein in a magnification change mode said second centering means further takes account of a magnification change ratio in calculating the amount of shift of the center of the trimmed image.

* * * * *